United States Patent [19]

Strauss

[11] Patent Number: 4,625,421

[45] Date of Patent: Dec. 2, 1986

[54] ARCHERY BOW SIGHTING DEVICE

[76] Inventor: Juergen M. Strauss, 29 Blairmore Dr., Trenton, N.J. 08690

[21] Appl. No.: 795,588

[22] Filed: Nov. 6, 1985

[51] Int. Cl.[4] ..... F41G 1/46

[52] U.S. Cl. ..... 33/265

[58] Field of Search ..... 33/265; 124/87

[56] References Cited

U.S. PATENT DOCUMENTS

| | | | |
|---|---|---|---|
| 2,654,152 | 10/1953 | La Vire | 33/265 |
| 3,163,938 | 1/1965 | Reynolds | 33/265 |
| 3,320,670 | 5/1967 | Ambraziatis | 33/265 |
| 3,574,944 | 4/1971 | Reynolds | 33/265 |
| 3,579,839 | 5/1971 | Kowalski | 33/265 |
| 3,696,517 | 10/1972 | Larson | 33/265 |
| 3,787,984 | 1/1974 | Bear et al. | 33/265 |
| 3,854,217 | 12/1974 | Killian | 33/265 |
| 4,020,560 | 5/1977 | Heck | 33/265 |
| 4,026,032 | 5/1977 | Smith | 33/265 |
| 4,136,462 | 1/1979 | Topel | 33/265 |
| 4,305,208 | 12/1981 | Larson | 33/265 |
| 4,457,076 | 7/1984 | Heck | 33/265 |
| 4,535,747 | 8/1985 | Kudlacek | 33/265 |

*Primary Examiner*—Richard R. Stearns

*Attorney, Agent, or Firm*—Sperry, Zoda & Kane

[57] ABSTRACT

An archery bow sighting device is disclosed which includes a body member as well as a vertical adjustment block and a longitudinal adjustment arm and a lateral adjustment bar which, as interconnected and interlocked with respect to one another, provide three complete degrees of freedom of a grouping of preset pin blocks each carrying pins to allow sighting for facilitating archery accuracy. The interlocking adjustment members are each selectively capable of being fixedly secured to prevent adjustment of any one, two or three degrees of freedom of movement. The sighting pins themselves are individually adjustable such that when the relative spacing between each sighting pin is finally achieved, they can be moved as a group, vertically, laterally, or longitudinally thereby preventing the necessity of adjusting each and every individual pin position when the archery conditions change such as a variation in wind, lighting, or other indeterminable factors.

4 Claims, 6 Drawing Figures

Fig. 4.
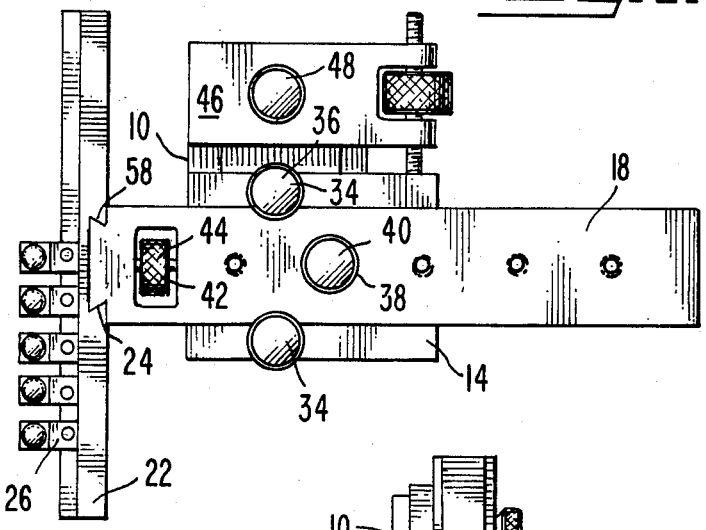
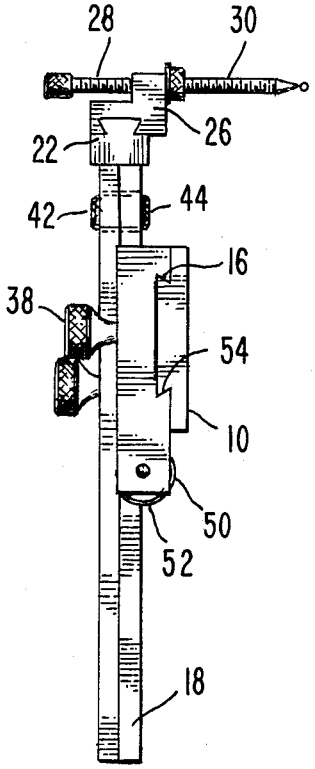
Fig. 2.
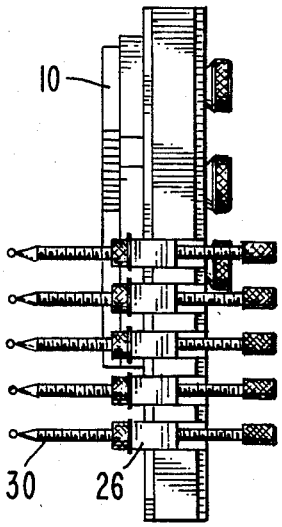
Fig. 5.
Fig. 3.
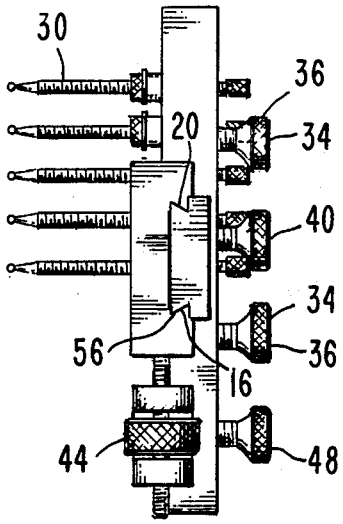
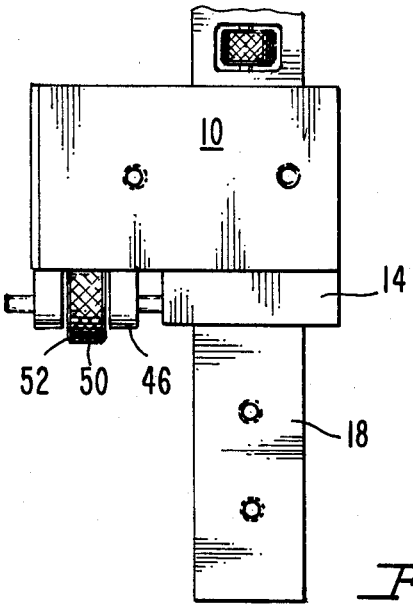
Fig. 6.

ARCHERY BOW SIGHTING DEVICE

BACKGROUND OF THE INVENTION

1. Field of the Invention

The present invention pertains to the field of devices for increasing the accuracy of bow sighting for both target archery and hunting archery. Many devices attempt to achieve these purposes by entirely different means each of which is intended to create an ability of the archer to repetitively be accurate in sighting and shooting. This necessity for repetitiveness is why a bow sighting device is required especially in target shooting.

2. Description of the Prior Art

A number of devices are currently being utilized by archers which have various adjustment capacities, however, none of these devices provides three complete degrees of freedom while also providing the ability to simultaneously move a multiplicity of pins which are in a fixed orientation with respect to one another. No device shows this ability to move this grouping of pins with three complete freedoms of movement without disturbing the relative positioning of the pins with respect to one another.

Certain prior art devices have been patented in this field of art including U.S. Pat. No. 2,654,152 patented Oct. 6, 1953 to J. A. La Vire on a Bow Sight. Also patented was U.S. Pat. No. 3,163,938 to R. J. Reynolds on a Archer's Sighting Device on Jan. 5, 1965. Further patented devices include U.S. Pat. No. 3,320,670 patented May 23, 1967 to W. A. Ambraziatis on a Bowsight; U.S. Pat. No. 3,579,839 patented May 25, 1971 to R. J. Kowalski on a Archery Bow Sight; U.S. Pat. No. 3,696,51 patented Oct. 10, 1972 to M. W. Larson on a Range Finder and Bow Sight; U.S. Pat. No. 4,020,560 patented May 3, 1977 to Albert Heck on Bow Sights and Methods of Making and Using the Same; U.S. Pat. No. 4,026,032 patented May 31, 1977 to J. T. Smith on a Bow Sight Mechanism, and U.S. Pat. No. 4,136,462 patented Jan. 30, 1979 to K. D. Topel on an Adjustable Crosshair Sight for Archery Bow.

SUMMARY OF THE INVENTION

The present invention provides an archery bow sighting device including a body member which is designed to be fixedly securable with respect to the shaft of an archery bow. A vertical coarse adjustment block is positioned adjacent to this body member and is vertically movable with respect thereto. A vertical interlocking means is positioned connected to the body and to the vertical coarse adjustment block to allow only vertical movement of these two members with respect to one another. This interlocking means preferably the form of a tongue and groove interlocking configuration. Also, if it is desired that the vertical coarse adjustment block will be fixedly positioned with respect to the body member to prevent movement along the direction dictated by the vertical interlocking means, a coarse vertical locking means is also provided in the form of a first thumbscrew means which abuts against the body member to it in its fixed position with respect to the coarse vertical adjustment block.

A longitudinal adjustment arm is positioned adjacent to the vertical coarse adjustment block and is longitudinally movable with respect thereto. A vertical interlocking means in the form of a tongue and groove interconnecting configuration allows only relative longitudinal movement of the longitudinal adjustment arm with respect to the vertical coarse adjustment block. Also, if it is desired to fix the longitudinal adjustment arm with respect to the vertical coarse adjustment block, a longitudinal locking means in the form of a second thumbscrew means can be positioned extending through the longitudinal interlocking means into abutting engagement with respect to the vertical interlocking means thereby preventing relative longitudinal movement therebetween.

A lateral adjustment bar is positioned adjacent to the longitudinal adjustment arm and is laterally movable with respect thereto. A lateral interlocking means is positioned connected to the longitudinal adjustment bar and the lateral adjustment bar to allow only such relative lateral movement between these two members. A lateral locking means may also be included to selectively fixedly secure the lateral adjustment bar with respect to the longitudinal adjustment arm and prevent lateral movement of these members with respect to one another. This lateral locking means preferably takes the form of a third thumbscrew means.

A plurality of pin blocks may be movably secured with respect to the lateral adjustment bar such that they can be moved vertically and thereby vary the relative positioning with respect to one another. Each pin block defines therein a pin mounting means which preferably may be a threaded bore into which one of the sighting pins may be secured. With a sighting pin secured inside each threaded bore of each pin block, each pin block when moved will thereby move a single sighting pin and in this manner they can establish a fixed relative orientation with respect to one another.

In this fixed relative relationship with respect to one another, the movement of the vertical coarse adjustment block will cause a vertical movement of the pins as a group. Similarly, the movement of longitudinal adjustment will cause a relative longitudinal movement of the pins as a group. Further similarly, movement of the lateral adjustment bar will cause lateral movement of each of the pins as a group while not changing the relative orientation with respect to each other pin.

The present invention may also include a vertical fine adjustment block which is positioned adjacent to the body member and adjacent to the vertical coarse adjustment block, and is vertically movable with respect to each of those members. This vertical fine adjustment block may include a fourth thumbscrew means extending through the vertical fine adjustment block into abutting engagement with respect to the body member to selectively secure this member with respect to the body member to prevent relative vertical movement therebetween, or when the fourth thumbscrew means is loosened to allow vertical relative movement therebetween. A vertical fine adjustment means may also be included which allows fine adjustment between the vertical adjustment block and the vertical coarse adjustment block when the vertical fine adjustment block is immovably secured with respect to the body member, and when at the same time the vertical coarse adjustment block is vertically movable with respect to the body member to allow fine vertical adjustment. Preferably, this vertical fine adjustment means comprises a threaded thumbscrew.

It is an object of the present invention to provide an archery bow sighting device using a plurality of individually adjustable pins to facilitate target and hunting bow accuracy.

It is an object of the present invention to provide an archery bow sighting device which provides three independent dimensions of sighting pin adjustment including vertical adjustment, longitudinal adjustment and lateral adjustment.

It is an object of the present invention to provide an archery bow sighting device which provides three degrees of freedom of movement for adjustment of a plurality of sighting pins while the pins are fixedly oriented with respect to one another.

It is an object of the present invention to provide an archery bow sighting device which moves a relatively fixed array of sighting pins in a lateral longitudinal and vertical direction as a group.

It is an object of the present invention to provide an archery bow sighting device which is relatively simple in construction.

It is an object of the present invention to provide an archery bow sighting device which is virtually maintenance free.

It is an object of the present invention to provide an archery bow sighting device which is extremely easy to use.

It is an object of the present invention to provide an archery bow sighting device which can be attached to virtually any type of archery bow.

It is an object of the present invention to provide an archery bow sighting device which can be tailored to the individual characteristics of the user.

It is an object of the present invention to provide an archery bow sighting device which includes adjustable adjustment characteristics to allow the archer to easily make changes in sighting due to humidity, variations in arrow, arrow rest or arrow fleching, variation in nocking point or peepsight, variation in shooting style, variations in sun or overcast conditions, or in chaning of the target, without requiring individual movement of the pins with respect to one another.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

FIG. 2 is a top plan view of the embodiment shown in FIG. 1;

FIG. 3 is a side plan view of the embodiment shown in FIG. 1 viewed from the right;

FIG. 4 is a front plan view of the embodiment shown in FIG. 1;

FIG. 5 is a side plan view of the configuration shown in FIG. 1 as seen from the left;

FIG. 6 is a rear plan view of the configuration shown in FIG. 1.

DETAILED DESCRIPTION OF THE PREFERRED EMBODIMENT

Figure 1:
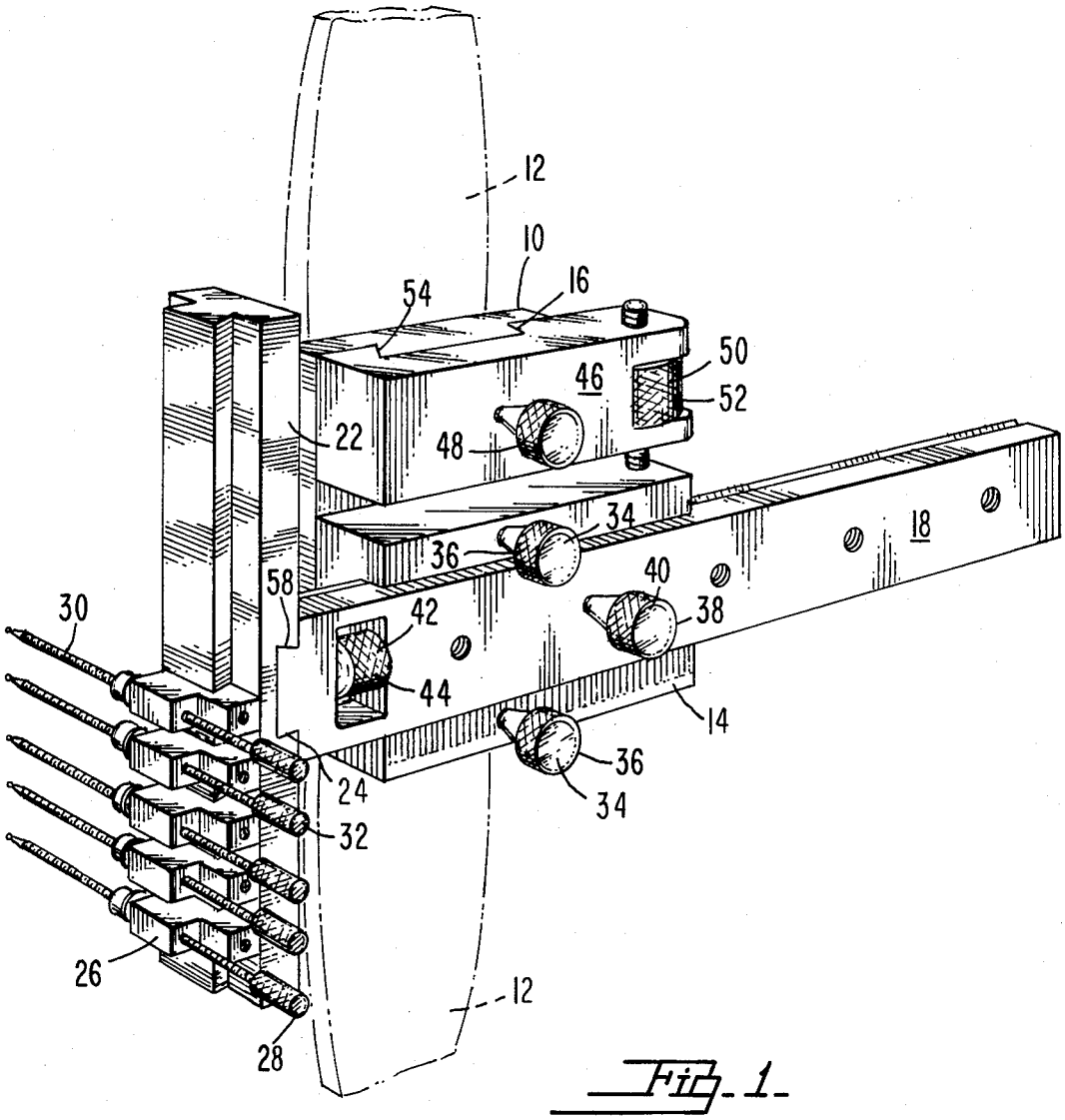
FIG. 1 is a perspective view of an embodiment of the archery bow sighting device of the present invention.

The present invention provides an archery bow sighting device which includes a body member 10 which is adapted to be fixedly secure with respect to any bow 12 in such a manner as to rigidly retain the body member 10 against bow 12. A plurality of sighting pins 30 are positioned movably with respect to the body member 10 and separated therefrom by a plurality of adjustment members.

A vertical coarse adjustment block 14 is movably secured with respect to the body member 10 by means of a vertical interlocking means 16. The vertical interlocking means 16 allows full freedom of vertical movement of the vertical coarse adjustment block with respect to the body member 10 and thereby also with respect to bow 12.

In a similar manner, a longitudinal adjustment arm 18 is movably secured with respect to the vertical coarse adjustment block 14 by means of a longitudinal interlocking means 20. This interlocking means maintains the longitudinal adjustment arm to be movable only in a longitudinal manner as shown in FIG. 1 being from left to right with respect to the vertical coarse adjustment block 14.

The last degree of freedom of movement of the sighting pins 30 with respect to the body member 10 and bow 12 is achieved by the lateral adjustment bar 22 which is interlocked via the lateral interlocking means 24 with respect to the longitudinal adjustment arm 18. Lateral movement is shown in FIG. 1 as movement from the left rear to the close right. A plurality of pin blocks 26 are movably secured with respect to the lateral adjustment bar 22. Each pin block 26 defines a pin mounting means 28 therein which may preferably take the form of a threaded bore 32 adapted to receive sighting pins 30 threaded therein. In this manner, vertical movement of the pin blocks 26 with respect to one another and with respect to the lateral adjustment bar 22 will allow a user to vary the relative positioning of the individual sighting pins 30 with respect to one another.

A coarse vertical locking means 34 may take the form of a first thumbscrew means 36 which extends through the vertical coarse adjustment block 14 such as to selectively be in abutment with respect to the body member 10. When the first thumbscrew means 36 is tightened, the vertical coarse adjustment block 14 and the body member 10 will be fixedly secured with respect to one another. However, if the user desires a change in the vertical positioning of the grouping of sighting pins 30, he can loosen the first thumbscrew means 36 and make the adjustment and then again tighten that thumbscrew.

A longitudinal locking means 38 may take the form of a second thumbscrew means which extends through the longitudinal adjustment arm into abutment with respect to the vertical coarse adjustment block. By tightening or loosening this second thumbscrew means 40, the user can very the longitudinal adjustment or the distance of the sighting pins 30 from the bow.

A lateral locking means 42 is preferably included in the form of a third thumbscrew means 44 which when tightened maintains a fixed lateral position of the lateral adjustment bar with respect to the longitudinal adjustment arm. However when loosened, the third thumbscrew means allows lateral movement of the lateral adjustment bar with respect to the longitudinal adjustment arm to move the sighting pins 30 to the left and right from the view of the archer.

A vertical fine adjustment block 46 may also be included which preferably includes a fourth thumbscrew means 48. When tightened, this thumbscrew means will secure the vertical fine adjustment block 46 with respect to the body member 10. Then in that configuration, if the coarse vertical locking means 34 or first thumbscrew means 36 is loosened, fine adjustment of the vertical positioning is possible. This vertical fine adjustment means takes the form of a threaded thumbwheel 52 which has a stud extending therefrom which is threaded into the vertical fine adjustment blocks 46 and is fixedly secured into the coarse vertical adjustment block 14. Thus, when thumbscrew 48 is tightened and thumbscrew 36 is loosened, movement of the threaded thumbwheel 52 will cause a fine vertical adjustment of positioning of the grouping of sighting pins 30.

To facilitate smooth operation of the vertical interlocking means 14, it should take the form of a tongue and groove member 54 as shown in FIG. 1. Furthermore, to facilitate smooth operation of the longitudinal interlocking means 20, it should take the form of a tongue and groove longitudinal interlocking configuration 56 as shown best in FIG. 3. Furthermore, the lateral interlocking means 24 should take the form of a tongue and groove configuration 58 as shown best in FIG. 1.

In operation the archer will initially set the vertical coarse adjustment block 14, the longitudinal adjustment arm 18 and the lateral adjustment bar 22 at the approximate desired locations. Then the user will set the individual positions of the sighting pins 30 such that they are in correct alignment for shooting at various distances. For example, if there are five pins the user may wish to set them for distances of 20, 30, 40, 50 and 60 yards. Once the relative positions are maintained, the user can vary the vertical, horizontal or in and out movement of these pins by varying the positioning of the vertical coarse adjustment block 14, the lateral adjustment bar 22, or the longitudinal adjustment arm 18, respectively. If any one of these three degrees of freedom is chosen for movement or adjustment, the archer can make the desired adjustment and yet not disturb the relative positioning of the individual sighting pins 30 since they are maintained fixedly secured after adjusted with respect to the lateral adjustment bar 22. Any change in conditions which affects one pin or one distance, would also affect another pin which is designated for a difference distance, and therefore a single adjustment for this varying characteristic would accomplish the desired change in positioning of all of the pins simultaneously without requiring individual movement thereof.

As an example, a sunny sky or an overcast sky makes a distinct change in the optical viewing of distance by the archer thereby requires a change in the vertical positioning of the grouping of sighting pins 30. This would be achieved by the user merely by loosening of the first thumbscrew means 36 and making the desired change after trial and error of the position of the vertical coarse adjustment block 14. Alternatively, the vertical fine adjustment means 50 may be moved as described hereabove. Another change in condition would be wind condition which could require a change in the lateral, vertical or longitudinal positioning of the pins and this could be determined by the archer by trial and error during practice prior to competitive shooting. A change in the type of arrow being used or the length of arrow or in the ambient humidity would also make changes which could be compensated for by moving of the grouping of pins and would not require any changing in the individual positioning of the pins with respect to one another. In other words, a single adjustment would accomplish the entire purpose.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. An archery bow sighting device comprising:

(a) a body member fixedly securable with respect to an archery bow to be immovable with respect thereto;

(b) a vertical coarse adjustment block positioned adjacent to said body member and being vertically movable connected thereto;

(c) a vertical interlocking means positioned connected to said body member and to said vertical coarse adjustment block to allow only vertical movement of said vertical coarse adjustment block with respect to said body member;

(d) a longitudinal adjustment arm positioned adjacent to said vertical coarse adjustment block and being longitudinally movably connected thereto;

(e) a longitudinal interlocking means positioned connected to said vertical coarse adjustment block and said longitudinal adjustment arm to allow only relative longitudinal movement therebetween;

(f) a lateral adjustment bar positioned adjacent to said longitudinal adjustment arm and being laterally movably connected thereto;

(g) a lateral interlocking means positioned connected to said longitudinal adjustment bar and said lateral adjustment bar to allow only relative lateral movement therebetween;

(h) a plurality of pin blocks movably secured with respect to said lateral adjustment bar, each pin block defining a pin mounting means therein;

(i) a plurality of sighting pins being mountable with respect to each of said pin mounting means of each of said pin blocks; and (j) a vertical fine adjustment block positioned adjacent to said body member and being vertically movable with respect thereto, said vertical fine adjustment block further including a thumbscrew means extending therethrough into abutting engagement with respect to said body member to selectively secure said vertical fine adjustment block with respect to said body member to prevent relative movement therebetween.

2. The device as defined in claim 1 further including a vertical fine adjustment means to allow fine adjustment between said vertical fine adjustment block and said vertical coarse adjustment block when said vertical fine adjustment block is immovably secured with respect to said body member and said vertical coarse adjustment block is vertically movable with respect to said body member to allow fine vertical adjustment.

3. The device as defined in claim 2 wherein said vertical fine adjustment means comprises a threaded thumbscrew.

4. An archery bow sighting device comprising:

(a) a body member fixedly securable with respect to an archery bow to be immovable with respect thereto;

(b) a vertical coarse adjustment block positioned adjacent to said body member and being vertically movably connected thereto;

(c) a vertical interlocking means positioned connected to said body member and to said vertical coarse adjustment block to allow only vertical movement of said vertical coarse adjustment block with respect to said body member, said vertical interlocking means comprising a tongue and groove interconnection;

(d) a coarse vertical locking means selectively securing said vertical coarse adjustment block with respect to said body member to selectively prevent relative vertical movement therebetween, said coarse vertical locking means comprising a first thumbscrew means which extends through said vertical coarse adjustment block into abutting engagement with respect to said body member;

(e) a longitudinal adjustment arm positioned adjacent to said vertical coarse adjustment block and being longitudinally movably connected thereto;

(f) a longitudinal interlocking means positioned connected to said vertical coarse adjustment block and said longitudinal adjustment arm to allow only relative longitudinal movement therebetween, said longitudinal interlocking means being a tongue and groove interconnection;

(g) a longitudinal locking means selectively securing said longitudinal adjustment arms with respect to said vertical coarse adjustment block to selectively prevent relative longitudinal movement therebetween, said longitudinal locking means comprising a second thumbscrew means which extends through said longitudinal adjustment arm into abutting engagement with respect to said vertical coarse adjustment block;

(h) a lateral adjustment bar positioned adjacent to said longitudinal adjustment arms and being laterally movably connected thereto;

(i) a lateral interlocking means positioned connected to said longitudinal adjustment bar and said lateral adjustment bar to allow only relative lateral movement therebetween, said lateral interlocking means being a tongue and groove interconnection;

(j) a lateral locking means selectively securing said lateral adjustment bar with respect to said longitudinal adjustment arm to selectively prevent relative lateral movement therebetween, said lateral locking means including a third thumbscrew means extending through said longitudinal adjustment arm into abutting engagement with respect to said lateral adjustment bar;

(k) a plurality of pin blocks vertically movably secured with respect to said lateral adjustment bar, each pin block defining a pin mounting means comprising a threaded bore therein;

(l) a plurality of sighting pins being mountable with respect to each of said pin mounting means of each of said pin blocks;

(m) a vertical fine adjustment block positioned adjacent to said body member and being vertically movable with respect thereto;

(n) a fourth thumbscrew means extending through said vertical fine adjustment block into abutting engagement with respect to said body member to selectively secure said vertical fine adjustment block with respect to said body member to prevent relative vertical movement therebetween; and (o) a vertical fine adjustment means comprising a threaded thumbscrew to allow fine adjustment between said vertical fine adjustment block and said vertical coarse adjustment block when said vertical fine adjustment block is immovably secured with respect to said body member and said vertical coarse adjustment block is vertically movable with respect to said body member to allow fine vertical adjustment.

* * * * *